US007398041B2

(12) United States Patent
Iwakura et al.

(10) Patent No.: US 7,398,041 B2
(45) Date of Patent: Jul. 8, 2008

(54) COLOR IMAGE FORMING APPARATUS USING BASE-LAYER

(75) Inventors: Yoshie Iwakura, Higashiosaka (JP); Susumu Murakami, Kyoto (JP); Kuniaki Nakano, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 159 days.

(21) Appl. No.: 11/220,211

(22) Filed: Sep. 6, 2005

(65) Prior Publication Data

US 2006/0055959 A1 Mar. 16, 2006

(30) Foreign Application Priority Data

Sep. 8, 2004 (JP) ..... 2004-261112

(51) Int. Cl.
*G03G 15/01* (2006.01)

(52) U.S. Cl. ..... 399/299; 399/302; 399/358; 399/359

(58) Field of Classification Search ..... 399/299, 399/66, 302, 298, 358, 359
See application file for complete search history.

(56) References Cited

U.S. PATENT DOCUMENTS 5,103,260 A * 4/1992 Tompkins et al.
6,175,702 B1 * 1/2001 Takeuchi et al. ..... 399/302
6,650,853 B1 * 11/2003 Sumikawa et al. ..... 399/302

FOREIGN PATENT DOCUMENTS

JP 11194576 A * 7/1999
JP 2000-190572 7/2000
JP 2002-099127 4/2002
JP 2004020661 A * 1/2004

* cited by examiner

*Primary Examiner*—David M. Gray
*Assistant Examiner*—Laura K Roth
(74) *Attorney, Agent, or Firm*—Renner, Otto, Boiselle & Sklar, LLP

(57) ABSTRACT

A color image forming apparatus 1 includes: a multiple number of process printing units 20, each having an photoreceptor drum 21 for bearing a developer image formed with a toner corresponding to a different color of color-separated image information; a transfer belt 31 to which a multiple number of developer images are comprised in layers; and a transfer roller 36 for transferring the developer images that have been comprised in layers on transfer belt 31, all at once, to recording paper, wherein the multiple number of process printing units 20 are arranged along transfer belt 31, and is characterized in that among the developer images to be transferred from the photoreceptor drums 21 of multiple image forming units 20 onto transfer belt 31, the toner for the developer image of the color to be transferred first is specified to produce a base-layer of the color images of information.

7 Claims, 4 Drawing Sheets

Fig. 3

| | Pulverized toner A | | Pulverized toner B | | Polymerized toner C | |
|---|---|---|---|---|---|---|
| | Offset | Direct compression | Offset | Direct compression | Offset | Direct compression |
| Amount of static charge(μC/g) | 15.20 | 14.20 | 19.60 | 20.00 | 41.00 | 46.00 |
| Amount of adherence (mg/cm$^2$) | 0.52 | 0.50 | 0.40 | 0.43 | 0.26 | 0.31 |

Fig. 4

| Secondary current (μA) | Transfer efficiency (%) | | |
|---|---|---|---|
| | Transfer condition 1 | Transfer condition 2 | Transfer condition 3 |
| 4 | 87.50 | 82.75 | 79.00 |
| 6 | 91.00 | 84.75 | 85.00 |
| 8 | 93.00 | 87.00 | 86.25 |
| 10 | 93.25 | 89.25 | 94.25 |
| 12 | 92.00 | 91.25 | 95.50 |
| 14 | 90.75 | 92.50 | 95.50 |
| 16 | 90.25 | 92.50 | 95.75 |
| 18 | 90.00 | 92.50 | 95.75 |
| 20 | 89.25 | 92.50 | 95.75 |
| 22 | 88.25 | 92.50 | 95.75 |
| 24 | | 92.50 | 95.75 |
| 26 | | 92.25 | 95.75 |
| 28 | | | 95.50 |
| 30 | | | 95.25 |
| 32 | | | 95.50 |
| 34 | | | 95.50 |

COLOR IMAGE FORMING APPARATUS USING BASE-LAYER

This Nonprovisional application claims priority under 35 U.S.C. §119(a) on Patent Application No. 2004-261112 filed in Japan on 8 Sep. 2004, the entire contents of which are hereby incorporated by reference.

BACKGROUND OF THE INVENTION (1) Field of the Invention

The present invention relates to a color image forming apparatus and in particular relates to a color image forming apparatus, such as a copier, printer, facsimile machine or the like, which uses electrophotography as a process of image forming, wherein developer images formed on image bearing members are transferred to a transfer medium.

(2) Description of the Prior Art

Recently, in the field of image forming apparatus, there is a common trend toward color configurations, and with the development of color image forming apparatus, an increased number of color image forming apparatus have become used.

Conventionally, in the field of color image forming apparatus, since it is necessary to reproduce a duplicate of an original with as faithful colors as possible, various kinds of image processing techniques for matching colors and hues have been used for color-balance adjustment.

As one example of an image processing technique, a configuration has been known whereby color balance adjustment is made by modifying color correction parameters based on the color information selected by the user and the information on the printing characteristics of the image forming apparatus (patent literature 1: Japanese Patent Application Laid-open 2000-190572).

The above technique is without doubt effective in being used in a direct transfer process in which each color developer is directly transferred to print paper. However, this method faces difficulties when it is applied to an indirect transfer process which is aimed at making the apparatus compact and achieving high-speed color printing.

A color image forming apparatus using the indirect transfer process uses an intermediate transfer medium and is configured so that layered images of separated color components are formed on the intermediate transfer medium, forming images of information (primary transfer) and then the laminated color images of information are transferred as a whole to the conveyed paper (secondary transfer), thus printing image information on the paper.

In this indirect transfer process, since the whole developer is not transferred at the stages of the primary transfer and the secondary transfer, account should be taken of the transfer efficiency.

Usually, the transfer efficiency in the indirect transfer process roughly ranges from 80 to 95%.

For example, the transfer efficiency falls within the range of 80 to 90% in the case of a spatial transfer process where a discharge type transfer mechanism is used for electrification, while the transfer efficiency falls within the range of 90 to 95% in the case of a pressing contact transfer process where a roller/brush or a similar element is used for electrification.

Accordingly, it is necessary to take into account the transfer efficiency if the aforementioned adjustment of color balance based on the image processing is effected at other than a 100% transfer efficiency.

The transfer efficiency in the indirect transfer process of each color varies not only depending on the amount of electricity on the developer on the photoreceptor for each color and the electric field generated by the transfer mechanism but also on the paper conditions (paper type, thickness, moisture content, etc.) of the sheet interposed between the photoreceptor and transfer mechanism.

This is why it has been difficult to provide an image process that can satisfy the user no matter which complicated process is performed for color balance adjustment.

In reference to the developers not having transferred at the primary and secondary transfer stages of the indirect transfer process, those involved in the primary transfer can be reused because each image forming unit always handles the developer of an unvaried color.

In the secondary transfer stage, however, the color of the untransferred or leftover developer varies depending on the image information. Therefore, the leftover developer collected from the intermediate transfer medium contains various colors of developers, which is not reusable hence has no other use than disposal. This increases the cost for the user, causing a problem in view of copy cost reduction.

SUMMARY OF THE INVENTION

The present invention has been devised in view of the above conventional problems, it is therefore an object of the present invention to provide a color image forming apparatus which is able to reproduce color image information presenting correct color balance as well as to reduce the copy cost by reusing the developer that is collected after transfer.

The color image forming apparatus according to the present invention for solving the above problems is configured as follows.

The color image forming apparatus according to Claim 1, is a color image forming apparatus comprising: a plurality of image forming units, each having an image bearing member for supporting a developer image formed with a developer corresponding to each color of color-separated image information; an intermediate transfer medium to which a multiple number of developer images are comprised in layers; and a transfer section for transferring the developer images that have been comprised in layers on the intermediate transfer medium, all at once, to a transfer medium, wherein the plurality of image forming units are arranged along the intermediate transfer medium, wherein among the developer images to be transferred from the image bearing members of the image forming units to the intermediate transfer medium, the developer for the developer image of the color to be transferred first is used to produce a base-layer of the color images of information.

The color image forming apparatus according to Claim 2 is characterized in that, in addition to the configuration defined in Claim 1, the developer for reproducing black image information is specified to be the developer for the developer image of the color to be transferred first.

The color image forming apparatus according to Claim 3 is characterized in that, in addition to the configuration defined in Claim 1, the base-layer is formed by the developer that is not transferred to the transfer medium and remains on the intermediate transfer medium when the developer image is transferred from the intermediate transfer medium to the transfer medium at the transfer section.

The color image forming apparatus according to Claim 4 is characterized in that, in addition to the configuration defined in Claim 1, the base-layer is formed to be a layer having a thickness of about 5% or lower of the total layer thickness of all the developers corresponding to all the colors of the color image information.

The color image forming apparatus according to Claim 5, includes, in addition to the configuration defined in Claim 1, an intermediate transfer medium cleaning means that is arranged at a position in abutment with the transfer surface of the intermediate transfer medium, and downstream of the transfer section and upstream of the image forming units with respect to the moving direction of the intermediate transfer medium, for scraping and collecting the leftover developer from the intermediate transfer medium after the developers have been transferred as a whole.

The color image forming apparatus according to Claim 6 includes, in addition to the configuration defined in Claim 5, a developer conveying device for conveying the developer that has been collected by the intermediate transfer medium cleaning means, to one developer storage container corresponding to a color, selected from the developer storage containers in image forming units for all the colors.

The color image forming apparatus according to Claim 7 is characterized in that, in addition to the configuration defined in Claim 6, the color of the selected developer storage container is specified to be black.

According to the inventions defined in Claims 1 to 7, in the color image forming apparatus, among the developer images to be transferred from the image bearing members of the image forming units to the intermediate transfer medium, the developer for the developer image of the color to be transferred first is film formed to be a base-layer of the color images of information, and color-balanced images of color developers are formed over the base-layer, whereby the developer images of all the colors over the base-layer can be transferred to the transfer medium, hence it is possible to reproduce color-balanced, correct color image information free from any color change in color balance.

Further, in addition to the above common effect obtained from the inventions according to Claims 1 to 7, each invention defined in the claims have the following effect.

Detailedly, in accordance with the present invention defined in Claim 2, specifying the developer for reproducing black image information to be the developer for the developer image of the color to be transferred first, makes it possible to form a base-layer which will not be affected by the other colors.

In accordance with the present invention defined in Claim 3, formation of the base-layer with the developer that is not transferred to the transfer medium and remains on the intermediate transfer medium when the developer image is transferred from the intermediate transfer medium to the transfer medium at the transfer section, makes it possible to produce a base-layer in a simple configuration without need of any extra base-layer forming means.

In accordance with the present invention defined in Claim 4, forming the base-layer to be a layer having a thickness of about 5% or lower of the total layer thickness of all the developers corresponding to all the colors of the color image information, makes it possible to transfer all the color developers comprised in layers on the intermediate transfer medium to the transfer medium without being affected by the layer thickness of the base-layer.

In accordance with the present invention defined in Claim 5, provision of an intermediate transfer medium cleaning means that is arranged at a position in abutment with the transfer surface of the intermediate transfer medium, and downstream of the transfer section and upstream of the image forming units with respect to the moving direction of the intermediate transfer medium, for scraping and collecting the leftover developer from the intermediate transfer medium after the developers have been transferred as a whole, makes it possible to reuse the developer that was left over on the intermediate transfer medium for forming the base-layer.

In accordance with the present invention defined in Claim 6, in addition to the effect of the invention defined in Claim 5, provision of a developer conveying device for conveying the developer that has been collected by the intermediate transfer medium cleaning means, to one developer storage container corresponding to a color, selected from the developer storage containers in image forming units for all the colors, makes it possible to achieve automatic collection of the developer into the selected developer storage container.

In accordance with the present invention defined in Claim 7, the color of the selected developer storage container is specified to be black. Accordingly, in addition to the effect described above, most of the leftover developer is black when the black developer is used as the developer for the base-layer, hence it is possible to make reuse of the developer because there is little change in black color from contamination of small amounts of the other colors.

BRIEF DESCRIPTION OF THE DRAWINGS

FIG. 3 is a table showing the amount of static charge on the toner and the amount of adherence of the toner to the photoreceptor drum, of two kinds of toners, in a color image forming apparatus according to one embodiment of the embodied configuration.

FIG. 4 is a table showing transfer efficiencies at the secondary transfer stage under three kinds of transfer conditions in the color image forming apparatus.

DESCRIPTION OF THE PREFERRED EMBODIMENTS

The best mode for carrying out the present invention will hereinafter be described with reference to the drawings.

Figure 1:
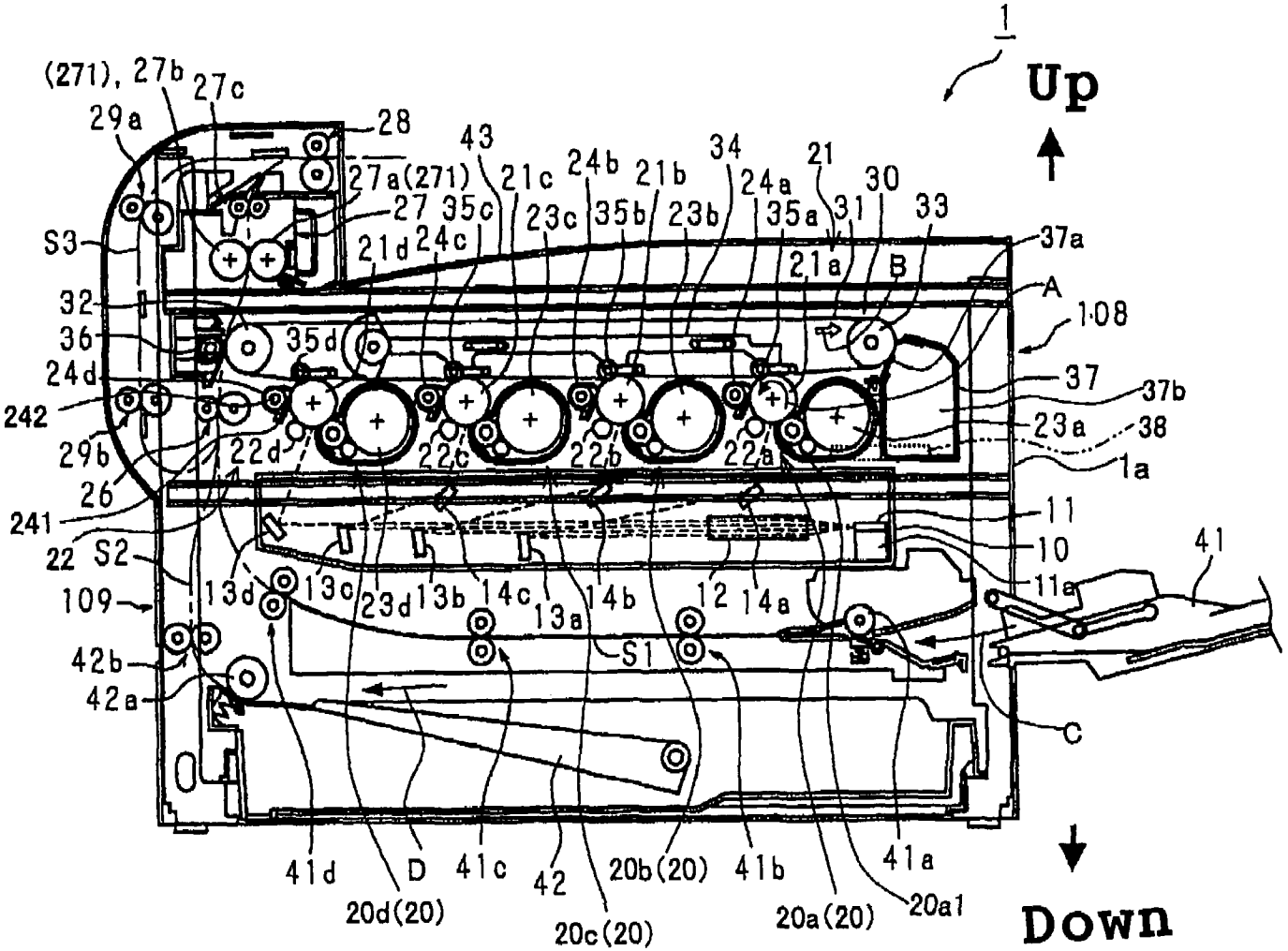
FIG. 1 is an illustrative diagram (sectional view from the rear) showing the overall configuration of a color image forming apparatus according to one embodied mode of the present invention.

FIG. 1 shows one example of the present invention, and is an illustrative diagram (sectional view from the rear) showing the overall configuration of a color image forming apparatus according to one embodied mode of the present invention.

As shown in FIG. 1, a color image forming apparatus 1 of the present embodiment includes: a plurality of image forming units or namely, process printing units 20 (20*a*, 20*b*, 20*c* and 20*d*) each having a photoreceptor drum 21 (21*a*, 21*b*, 21*c* or 21*d*) for supporting a developer image formed with a developer (which will be referred to as "toner" hereinbelow) corresponding to the color of color-separated image information; a transfer belt 31 as an intermediate transfer medium to which a multiple number of developer images are comprised in layers; and a transfer roller 36 as a constituent of a transfer section for transferring the developer images that have been comprised in layers on the transfer belt 31, all at once, to a recording sheet as a transfer medium, and is characterized in that the plurality of process printing units 20*a*, 20*b*, 20*c* and 20*d* are arranged along the transfer belt 31, and among the developer images to be transferred from photoreceptor drums 21*a*, 21*b*, 21*c* and 21*d* of process printing units 20*a*, 20*b*, 20*c* and 20*d* to transfer belt 31, the toner for the developer image of the color to be transferred first, is film formed on the transfer belt 31 to produce a base-layer of the color images of information.

Here, concerning the positional relationship between the color image forming apparatus 1 and the operator in the present embodied mode, the operator is supposed to stand at an unillustrated side of the color image forming apparatus 1 shown in FIG. 1. In other words, the control side is located on the unillustrated side of color image forming apparatus 1, and the left and right sides as one faces FIG. 1 are the reverse of those when the operator faces the control side.

In the following description, the front side (F-side) refers to the operator side and the rear side (R-side) refers to the backside of color image forming apparatus 1, or the side shown by FIG. 1.

To begin with, the overall configuration of color image forming apparatus 1 will be described.

As shown in FIG. 1, color image forming apparatus 1 according to the present embodied mode is a so-called digital color printer which is adapted to output a color image by separating color image information into images of individual colors, is mainly composed of an image forming portion 108 and a paper feed portion 109, and forms multi-color images or monochrome images on a recording sheet in accordance with a print job sent from an information processor (not illustrated) such as a personal computer etc., externally connected.

Image forming portion 108 forms multi-color images based on electrophotography with yellow (Y), magenta (M), cyan (C) and black (K) colors. This image forming portion is mainly composed of an exposure unit 10, process printing units 20 as image forming units, a fixing unit 27, a transfer belt unit 30 having a transfer belt 31 as an intermediate transfer medium, and a transfer belt cleaning unit 37 as an intermediate transfer medium cleaning means.

Describing the overall arrangement of image forming portion 108, fixing unit 27 is disposed on the top at one end side of a housing 1*a* of color image forming apparatus 1, transfer belt unit 30 is extended under the fixing unit 27 from the one end side to the other endside of housing 1*a*, process printing units 20 are disposed under the transfer belt unit 30, and exposure unit 10 is disposed under the process printing units 20. Further, transfer belt cleaning unit 37 is arranged on the other side end of transfer belt unit 30. Also, a paper output tray 43 is arranged contiguous to fixing unit 27, over image forming portion 108.

Paper feed portion 109 is arranged under the image forming portion 108.

In the present embodied mode, as process printing units 20, four process printing units 20*a*, 20*b*, 20*c* and 20*d*, corresponding to individual colors, i.e., black (K), yellow (Y), magenta (M) and cyan (C), are arranged in the order mentioned along transfer belt 31.

The process printing unit 20*a* for the color whose developer image, among all the developer images to be transferred to transfer belt 31, is transferred to transfer belt 31 first, or in other words, the process printing unit 20*a* which is located at a position most distant from transfer roller 36, holds a toner of black color so as to form a black developer image first on transfer belt 31.

These process printing units 20*a*, 20*b*, 20*c* and 20*d* are arranged in parallel to each other, in the approximately horizontal direction (in the left-to-right direction in the drawing) in housing 1*a*, and include respective photoreceptor drums 21*a*, 21*b*, 21*c* and 21*d* as the image bearing member for each individual associated color, respective charging devices 22*a*, 22*b*, 22*c* and 22*d* for charging the photoreceptor drums 21*a*, 21*b*, 21*c* and 21*d*, respective developing devices 23*a*, 23*b*, 23*c* and 23*d* and respective cleaner units 24*a*, 24*b*, 24*c* and 24*d* and other components.

Here, the symbol a, b, c, and d are added to the constituents so as to show correspondence to black (K), yellow (Y), magenta (M) and cyan (C), respectively. In the description hereinbelow, however, the constituents provided for each color are generally referred to as photoreceptor drum 21, charging device 22, developing device 23, and cleaner unit 24, except in the case where a constituent corresponding to a specific color needs to be specified.

Photoreceptor drum 21 is arranged so that part of its outer peripheral surface comes into contact with the surface of transfer belt 31 while charging device 22 as an electric field generator, developing device 23 and cleaner unit 24 are arranged along, and close to, the outer peripheral surface of the drum.

As charging device 22, a roller type charger is used and arranged, at a position on the approximately opposite side across photoreceptor drum 21, from transfer belt unit 30, and in contact with the outer peripheral surface of photoreceptor drum 21. Though in the present embodied mode a roller type charger is used as charging device 22, a brush type charger, discharging type charger may be used in place of the roller type charger.

Developing device 23 holds a toner of black (K), yellow (Y), magenta (M) or cyan (C) color and is arranged on the downstream side of charging device 22 with respect to the rotational direction of the photoreceptor drum (in the direction of arrow A in the drawing), so that the toner of each color is supplied to the electrostatic latent image formed on the peripheral surface of the photoreceptor drum 21 to produce a visual image.

Cleaner unit 24 is arranged on the upstream side of charging device 22 with respect to the rotational direction of the photoreceptor drum. Cleaner unit 24 has a cleaning blade 241 and is configured so that the cleaning blade 241 is positioned in abutment with the outer peripheral surface of photoreceptor 21 so as to scrape and collect the leftover toner off the photoreceptor drum 21. A reference numeral 242 in the drawing designates a conveying screw for conveying the collected toner.

Exposure unit 10 is to create an electrostatic latent image by radiating a laser beam onto the surface of photoreceptor drum 21 of each color in accordance with the image data for printing, and is composed of a laser scanning unit (LSU) 11 having a laser illuminator 11*a*, a polygon mirror 12 and reflection mirrors 13*a*, 13*b*, 13*c*, 13*d*, 14*a*, 14*b* and 14*c* for reflecting the laser beam for different colors.

The laser beam emitted from laser illuminator 11*a* is separated into components for different colors, by polygon mirror 12, so that the separated components of light are reflected by respective reflection mirrors 13*a* to 13*d* and 14*a* to 14*c* to illuminate the corresponding photoreceptor drums 21 of every color.

Here, concerning laser scanning unit 11, a writing head made up of an array of light emitting devices such as EL (electro luminescence), LED (light emitting diode) and others, may also be used instead of laser illuminator 11*a*.

Transfer belt unit 30 is mainly composed of transfer belt 31, a transfer belt drive roller 32, a transfer belt driven roller 33, a transfer belt tension mechanism 34, intermediate transfer rollers 35*a*, 35*b*, 35*c* and 35*d*.

In the following description, any of the intermediate transfer rollers 35*a*, 35*b*, 35*c* and 35*d* will be referred to as intermediate transfer rollers 35 when general mention is made.

Transfer belt 31 is formed of an endless film of about 75 μm to 120 μm thick. Transfer belt 31 is made from polyimide, polycarbonate or the like.

Also, transfer belt 31 is tensioned by transfer belt drive roller 32, transfer belt driven roller 33, transfer belt tension mechanism 34 and intermediate transfer rollers 35 so that its surface comes into contact with the outer peripheral surfaces of photoreceptor drums 21, and is adapted to move in the auxiliary direction (in the direction of arrow B in the drawing) by a driving force of the transfer belt drive roller 32.

Transfer belt drive roller 32 is disposed at one end side of housing 1*a*, and is wound with transfer belt 31 so as to drive the transfer belt 31 by applying a driving force whilst nipping and pressing the transfer belt 31 and a recording sheet together between itself and transfer roller 36 to convey the recording sheet.

Transfer roller 36 as a constituent of the transfer section is arranged opposing transfer belt drive roller 32 at approximately the same level and in parallel thereto and pressing against the transfer belt 31 wound on the transfer belt drive roller 32, forming a predetermined nip therewith while being applied with a high voltage of a polarity (+) opposite to the polarity (−) of the static charge on the toner, for transferring the multi-color developer image formed on the transfer belt 31 to the recording sheet.

In order to produce a constant nip between transfer belt 31 and transfer roller 36, either transfer belt drive roller 32 or transfer roller 36 may be formed of a hard material such as metal or the like while the other roller may be formed of a soft material such as elastic rubber, foamed resin, etc.

A registration roller 26 is provided under transfer belt drive roller 32 and transfer roller 36. This registration roller 26 is configured to set the front end of a recording sheet fed from paper feed portion 109 aligned with the leading end of the developer image on transfer belt 31 and deliver the sheet toward the transfer roller 36 side.

Transfer belt driven roller 33 is disposed on the other end side of housing 1*a*, so as to suspend and tension the transfer belt 31 approximately horizontally from the one end side to the other end side of housing 1*a*, in cooperation with transfer belt drive roller 32.

Intermediate transfer rollers 35 are arranged in the interior space of transfer belt 31 wound between transfer belt drive roller 32 and transfer belt driven roller 33 so as to abut the inner surface of transfer belt 31 and press its outer peripheral surface against the outer peripheral surfaces of the photoreceptor drums 21.

Further, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft.

Each of the thus formed intermediate transfer rollers 35 is applied with a high-voltage transfer bias for transferring the developer image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

Transfer belt cleaning unit 37 has a cleaning blade 37*a* arranged near transfer belt driven roller 33 so that the cleaning blade 37*a* can abut transfer belt 31 and scrape and collect the leftover toner from transfer belt 31.

Also, transfer belt cleaning unit 37 is located near process printing unit 20*a*, on the upstream side of the process printing unit 20*a* with respect to the moving direction of transfer belt 31. Further, a toner conveying device 38 is arranged to establish connection from a toner collector 37*b* in transfer belt cleaning unit 37 to a toner storage container 20*a*1 in process printing unit 20*a*.

Figure 2:
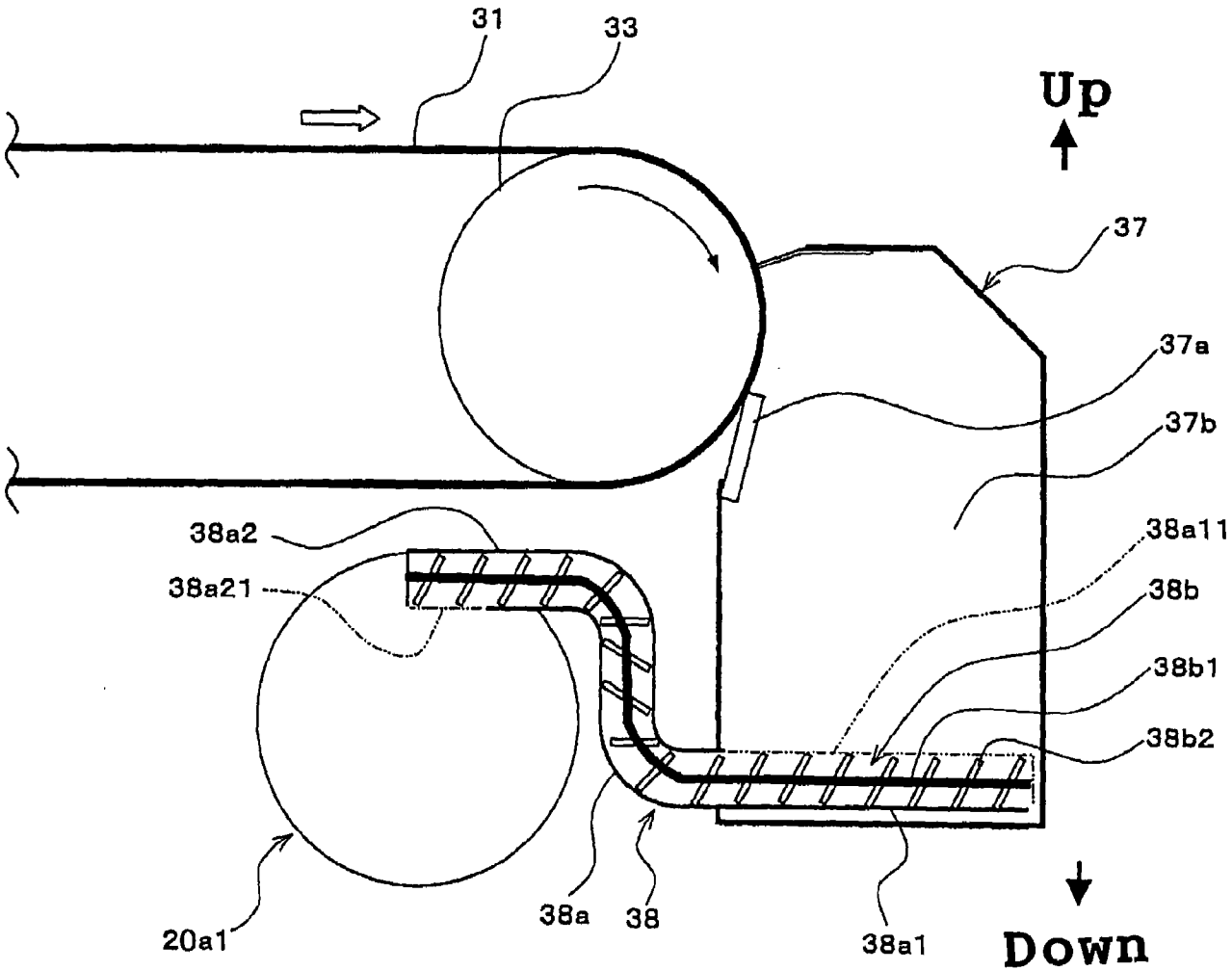
FIG. 2 is an illustrative diagram showing the configuration of a toner conveying device in the color image forming apparatus.

This toner conveying device 38 is mainly composed of, as shown in FIG. 2, atoner conveyance case 38*a* for establishing connection between the bottom of toner collector 37*b* and the upper part of toner storage container 20*a*1, and a conveying screw 38*b* extended along the interior of the toner conveyance case 38*a* for conveying toner from toner collector 37*b* to toner storage container 20*a*1.

Toner conveyance case 38*a* is constructed so that its one end part 38*a*1 is laid out at the bottom in toner collector 37*b* and an opening 38*a*11 that opens on top is formed so as to expose conveying screw 38*b* to the above space while the other end 38*a*2 is laid out in the upper part inside toner storage container 20*a*1 and another opening 38*a*21 that opens to the bottom is formed in toner storage container 20*a*1.

Conveying screw 38*b* is mainly composed of a flexible rotational shaft 38 which is rotatable even when flexed and a plurality of conveying vanes 38*b*2 which are formed so as to be tilted against the axial direction of rotational shaft 38*b*1 and parallel to each other. These conveying vanes 38*b*2 have a disk-like configuration and integrally rotate together with the rotational shaft 38*b*1 as it turns so as to convey the toner from toner collector 37*b* to toner storage container 20*a*1.

It should be noted that conveying screw 38*b* is not limited to the above configuration, but for example, a flexible spiral rotational axis having a wide spiral vane may be used.

Fixing unit 27 includes: as shown in FIG. 1, paired fixing rollers 271 consisting of a heat roller 27*a* and a pressing roller 27*b*; and a conveying roller 27*c* above the fixing rollers 271. A recording sheet is input from below fixing rollers 271 and output to above conveying roller 27*c*.

A paper discharge roller 28 is arranged above fixing unit 27, so that the recording sheet conveyed from conveying roller 27*c* is discharged by the paper discharge roller 28 to a paper output tray 43.

Referring to the fixing of a developer image by fixing unit 27, a heating device (not shown) such as a heater lamp or the like, provided inside or close to heat roller 27*a* is controlled based on the detected value from a temperature detector (not shown) so as to keep the heat roller 27*a* at a predetermined temperature (fixing temperature) while the recording sheet with a developer image transferred thereon is heated and pressed between heat roller 27*a* and pressing roller 27*b* as it is being conveyed and rolled, so that the developer image is thermally fused onto the recording sheet.

A duplex printing paper path S3 for double-sided printing is constructed adjacent to fixing unit 27, from the rear of fixing unit 27 downward to the vicinity of paper feed portion 109. Conveying rollers 29*a* and 29*b* are arranged at the top, and bottom and along the duplex printing paper path S3, so that the recording sheet is delivered again toward transfer roller 36 with its face inverted.

Specifically, conveying roller 29*a* is disposed at the rear of fixing unit 27 and conveying roller 29*b* is located below conveying roller 29*a* with respect to the top and bottom direction and at approximately the same level as registration roller 26.

Next, the configuration of paper feed portion 109 will be described.

Paper feed portion 109 includes a manual feed tray 41 and paper feed cassette 42 for holding recording sheets to be used for image forming, and is adapted to deliver recording sheets, one by one, from manual feed tray 41 or paper feed cassette 42 to image forming portion 108.

As shown in FIG. 1, manual feed tray 41 is arranged at one side end (on the right side in the drawing) of housing 1*a* of color image forming apparatus 1 so that it can be unfolded outside when used and folded up to the one end side when unused. This tray delivers paper, one by one, into the housing 1*a* of color image forming apparatus 1 when the user places a few recording sheets (necessary number of sheets) of a desired type.

Arranged on the downstream side with respect to the paper feed direction (the direction of arrow C in the drawing) of recording sheet by manual feed tray 41, inside housing 1*a* of color image forming apparatus 1, is a pickup roller 41*a* below exposure unit 10. Conveying rollers 41*b*, 41*c* and 41*d* are also disposed at approximately the same level along the path downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

Conveying roller 41*d* located on the most downstream side is positioned above conveying rollers 41*b* and 41*c*, so as to convey recording sheet upward.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided obliquely above and on the downstream side of the pickup roller 42*a* with respect to the recording paper feed direction (the direction of arrow D in the drawing).

Pickup roller 42*a* picks up one edge of the surface of the topmost recording sheet of a stack of recording sheets on paper feed cassette 42 and reliably feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by color image forming apparatus 1 in the present embodied mode will be described.

Color image forming apparatus 1 is constructed so as to transfer the developer images formed on photoreceptor drums 21 to a recording sheet fed from paper feed portion 109 by a so-called intermediate transfer process, or via transfer belt unit 30.

First, charging device 22 uniformly electrifies the outer peripheral surface of photoreceptor drum 21 at a predetermined voltage.

The electrified photoreceptor drums 21 are irradiated with a laser beam from exposure unit 10, so that a static latent image for every color is formed on the photoreceptor drum 21 for each color.

Then, toner is supplied from developing device 23 to the outer peripheral surface of photoreceptor drum 21 so that the static latent image formed on the outer peripheral surface of photoreceptor drum 21 is visualized with toner (to be a developer image).

The developer images formed on photoreceptor drums 21 are transferred to transfer belt 31.

Transfer of the developer image from photoreceptor drum 21 to transfer belt 31 is done by intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presents the opposite polarity (+). The developer image bearing negative (−) charge, on photo receptor drum 21 is transferred to transfer belt 31 as the photoreceptor drum 21 turns and comes into contact with transfer belt 31.

The developer images of colors formed on respective photoreceptor drums 21 are transferred to transfer belt 31 as it moves, and overlaid one over another, thus a color developer image is formed on transfer belt 31.

In this way, the developer images developed from static latent images on photoreceptor drums 21 for every color, are laminated on transfer belt 31 so that the image for printing is reproduced as a multi-color developer image on transfer belt 31.

Then, as transfer belt 31 moves and reaches the position where the recording sheet and the transfer belt 31 meet, the multi-color developer image on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When recording sheet placed on manual feed tray 41 is used, the paper is taken in by pickup roller 41*a* from manual feed tray 41, sheet by sheet, at controlled timings by instructions from the control panel (not shown), and fed into the machine.

The recording sheet thus taken into the machine is conveyed along recording paper feed path S1 by conveying rollers 41*b*, 41*c* and 41*d* to image forming portion 108.

When recording paper accommodated in paper feed cassette 42 is used, the paper is separated and fed from paper feed cassette 42, sheet by sheet, by pickup roller 42*a*, and conveyed along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the developer image on transfer belt 31, so that the developer image on transfer belt 31 is transferred to the recording sheet.

The recording sheet with a developer image formed thereon is further conveyed approximately vertically and reaches fixing unit 27, where the developer image is thermally fixed to the recording sheet by heat roller 27*a* and pressing roller 27*b*.

The recording sheet having passed through fixing unit 27, is discharged by discharge roller 28 when one-sided printing is selected, and placed face down on paper output tray 43.

In contrast, when double-sided printing is selected, the recording sheet is stopped and nipped by paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is to be printed, or the trailing edge of the sheet at the first printing is directed to the leading end when the underside is to be printed.

After the developer image is transferred and thermally fixed to the underside of the recording sheet, the sheet is discharged to paper output tray 43 by paper discharge roller 28.

Thus, the transfer operation to the recording sheet is done as described above.

Next, formation of a base-layer on the transfer belt by color image forming apparatus 1 in the present embodied mode and transfer efficiency will be described with reference to the drawings based on the embodiment.

Embodiment

This embodiment is one example of the embodied mode described above. As shown in FIG. 1, color image forming apparatus 1 includes four process printing units 20*a*, 20*b*, 20*c* and 20*d* laid out in the moving direction of transfer belt 31, in the order of black (K), yellow (Y), magenta (M) and cyan (C), from the upstream side. Formation of the developer image of black toner on transfer belt 31 by the process printing unit 20*a* for black color first, enables preparation of the toner that will remain on transfer belt 31 after the secondary transfer, with black toner only, in other words, black toner is used to form a base-layer, then color toners are successively laid over the base-layer by process printing units 20*b*, 20*c* and 20*d* to complete a color image.

According to the intermediate transfer process of color image forming apparatus 1, since the primary transfer is a transfer process from photoreceptor drums 21 to transfer belt 31, it is possible to obtain a stable transfer efficiency, specifically approximately 98% or greater without regards to the type of developer (to be referred to as "toner").

In contrast, in the secondary transfer stage, since toner particles have been pressed against transfer belt 31 and packed upon the primary transfer, and also various kinds of transfer media (recording paper) are used, it is impossible to assure a stable transfer efficiency. In particular, when a pulverized toner is used as the developer, the toner presents a strong tendency to pack and also the toner is unstable in electrification, hence the above-described tendency becomes noticeable.

Now, the transfer efficiency of the developer image formed on transfer belt 31 at the secondary transfer stage in this embodiment will be discussed by comparison of three kinds of transfer conditions.

Figure 5:
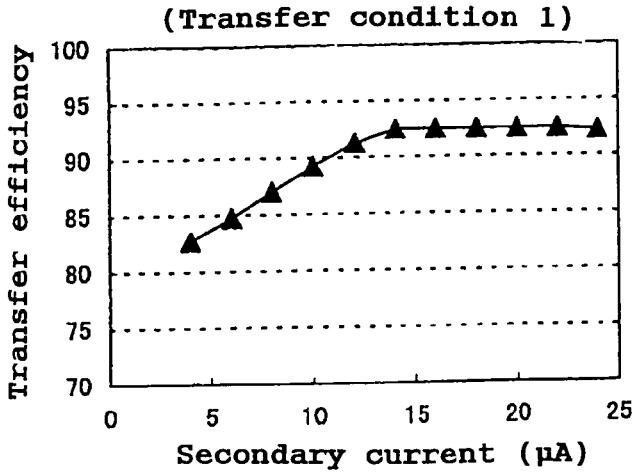
FIG. 5 is a graph showing the relationship between the transfer efficiency and the secondary current when secondary transfer is implemented under the transfer condition 1 in the color image forming apparatus.
Figure 6:
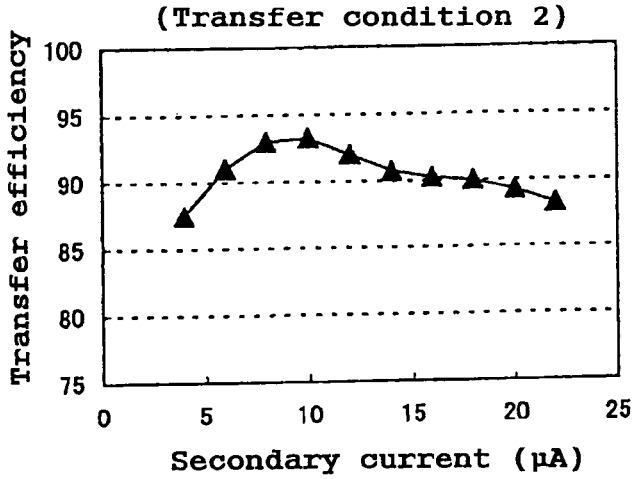
FIG. 6 is a graph showing the relationship between the transfer efficiency and the secondary current when secondary transfer is implemented under the transfer condition 2 in the color image forming apparatus.
Figure 7:
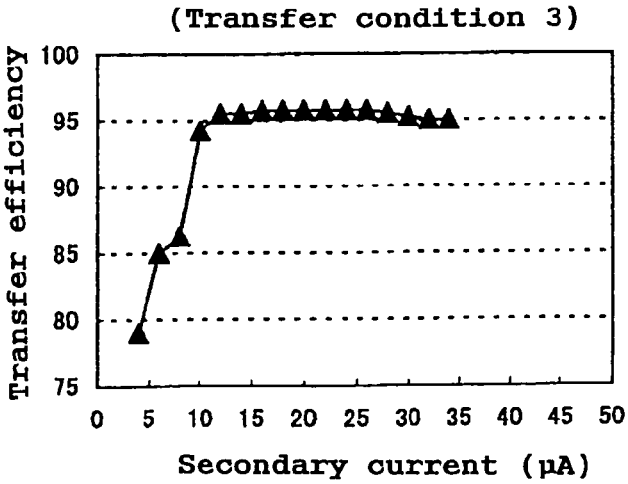
FIG. 7 is a graph showing the relationship between the transfer efficiency and the secondary current when secondary transfer is implemented under the transfer condition 3 in the color image forming apparatus.

FIG. 3 is a table showing, the amount of static charge on toner and the amount of adherence of toner to the photoreceptor drum, of two kinds of toners, in a color image forming apparatus according to the present embodiment. FIG. 4 is a table showing transfer efficiencies at the secondary transfer stage under three kinds of transfer conditions in the present embodiment. FIGS. 5 to 7 are graphs showing the relationship between the transfer efficiency and the secondary current under different transfer conditions.

Transfer conditions are as follows.

Transfer condition 1: a single layered image with a pulverized toner A

Transfer condition 2: a multi layered image with a pulverized toner A

Transfer condition 3: a single layered image with a polymerization toner B

FIG. 3 shows the amount of adherence and amount of static charge of each toner on photoreceptor drum 21, in offset mode and in direct compression mode.

As understood from the table in FIG. 3, in comparison between pulverized toner A and polymerization toner B, polymerization toner B presents a greater amount of static charge and a lower amount of adherence than pulverized toner A.

In one word, pulverized toner A and polymerization toner B are different in characteristics.

Next, the behavior of the transfer efficiency depending on the secondary current in the transfer conditions 1, 2 and 3 using pulverized toner A or polymerization toner B, will be described.

In condition 1, pulverized toner A presents the maximum transfer efficiency, 93.25% when the secondary current is at around 10 μA, as shown in FIGS. 3 and 4.

In condition 2, pulverized toner A presents the maximum transfer efficiency, 92.5% when the secondary current is at around 14 to 22 μA, as shown in FIGS. 3 and 5.

In condition 3, polymerization toner B presents the maximum transfer efficiency, 95.75% when the secondary current is at around 16 to 26 μA, as shown in FIGS. 3 and 6.

From the above result, it can be confirmed that a transfer efficiency of about 95% can be realized at the secondary transfer stage even with the toners having different characteristics as described above.

Thus, according to the present embodiment, formation of the toner layer of the developer image on transfer belt 31 by increasing the total thickness of the toner layer by about five percent, makes it possible to provide close to the necessary amount of toner for the final image.

More specifically, the image that is first transferred to the transfer belt, i.e., the image to be formed on the first process printing unit 20*a*, is formed by adding an amount of toner not more than 5% of the total amount of the toners for all the colors of the color image information, or by adding the amount of toner corresponding to that of the toner that is expected not to be transferred to the recording sheet and remain on the transfer belt 31, as a base-layer, to the nominal amount of the developer image to be formed first. This makes it possible to transfer the necessary amount of toner for the laminated developer images to the recording sheet at the secondary transfer stage.

Further, in the present embodiment, since the color of process printing unit 20*a* is specified to be black, formation of the base-layer with the black toner into a layer having a thickness of about 5% or lower of the total layer thickness of the final developer image will not cause any influence on the other color toners even if some fluctuation of transfer efficiency occurs. Therefore, it is possible to provide a transfer image excellent in color balance.

According to the configuration of the embodied mode and the embodiment described above, in color image forming apparatus 1, among the developer images to be transferred from photoreceptor drums 21 of a plurality of process printing units 20 onto transfer belt 31, the toner for the developer image of the color that is transferred first is film formed to be the base-layer for the color image information, and color-balanced images of color toners are formed over the base-layer, whereby the developer images of all the colors over the base-layer can be transferred to the transfer medium, hence it is possible to reproduce color-balanced, correct color image information free from any color change in color balance.

Further, according to the present embodiment, provision of toner conveying device 38 makes it possible to return the toner that was left over on transfer belt 31 and has been collected by transfer belt cleaning unit 37 therefrom to toner storage container 20*a*1 of process printing unit 20*a*. Thus, it is possible to reuse the leftover toner, hence reduce toner cost.

Moreover, even if small amounts of toners of the other colors get mixed in when the leftover toner is collected from transfer belt 31, most part of the leftover toner is expected to the back toner because the base-layer is formed by the black toner. Therefore, it is possible to recycle the black toner because there is little change in black color from reuse of the leftover toner.

Resultantly, according to the present embodiment, while it is possible to realize a use efficiency of approximately 100% of color toners, it is also to achieve a use efficiency of black toner close to 100% by recycling. Further, since color reproducibility is improved with non-use of extra toner, the image quality is also made stable.

Finally, the color image forming apparatus of the present invention should not be limited to the above embodied mode and the embodiment, and obviously various changes in the structure may be made without departing from the scope of the invention.

What is claimed is:

1. A color image forming apparatus comprising:

a plurality of image forming units, each having an image bearing member for supporting a developer image formed with a developer corresponding to each color of color-separated image information;

an intermediate transfer medium to which a multiple number of developer images are comprised in layers; and a transfer section for transferring the developer images that have been comprised in layers on the intermediate transfer medium, all at once, to a transfer medium, wherein the plurality of image forming units are arranged along the intermediate transfer medium, characterized in that among the developer images to be transferred from the image bearing members of the image forming units to the intermediate transfer medium, the developer for the developer image of the color to be transferred first is used to produce a base-layer of the color images of information, wherein the image forming unit for the developer image of the color to be transferred first is configured to form the base-layer by the addition of toner in an amount beyond the toner amount for forming the developer image such that the base-layer remains on the intermediate transfer medium following image transfer by the transfer section.

2. The color image forming apparatus according to claim 1, wherein the developer for reproducing black image information is specified to be the developer for the developer image of the color to be transferred first.

3. The color image forming apparatus according to claim 1, wherein the base-layer is formed by the developer that is not transferred to the transfer medium and remains on the intermediate transfer medium when the developer image is transferred from the intermediate transfer medium to the transfer medium at the transfer section.

4. The color image forming apparatus according to claim 1, wherein the base-layer is formed to be a layer having a thickness of about 5% or lower of the total layer thickness of all the developers corresponding to all the colors of the color image information.

5. The color image forming apparatus according to claim 1, further comprising an intermediate transfer medium cleaning means that is arranged at a position in abutment with the transfer surface of the intermediate transfer medium, and downstream of the transfer section and upstream of the image forming units with respect to the moving direction of the intermediate transfer medium, for scraping and collecting the leftover developer from the intermediate transfer medium after the developers have been transferred as a whole.

6. The color image forming apparatus according to claim 5, further comprising a developer conveying device for conveying the developer that has been collected by the intermediate transfer medium cleaning means, to one developer storage container corresponding to a color, selected from the developer storage containers in image forming units for all the colors.

7. The color image forming apparatus according to claim 6, wherein the color of the selected developer storage container is specified to be black.

* * * * *